US008201819B2

(12) United States Patent
Asari et al.

(10) Patent No.: US 8,201,819 B2
(45) Date of Patent: Jun. 19, 2012

(54) VALVE DEVICE AND PAPER SHEET PICKUP APPARATUS

(75) Inventors: Yukio Asari, Yokohama (JP); Yusuke Mitsuya, Yokohama (JP); Yoshihiko Naruoka, Yokohama (JP); Toru Todoriki, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 256 days.

(21) Appl. No.: 12/711,490

(22) Filed: Feb. 24, 2010

(65) Prior Publication Data

US 2011/0042886 A1 Feb. 24, 2011

(30) Foreign Application Priority Data

Aug. 19, 2009 (JP) ..... 2009-190308

(51) Int. Cl.
*B65H 3/08* (2006.01)

(52) U.S. Cl. ..... 271/108; 271/96; 251/208

(58) Field of Classification Search ..... 271/90, 271/94, 96, 108; 251/301, 205, 208
See application file for complete search history.

(56) References Cited

U.S. PATENT DOCUMENTS 3,942,951 A * 3/1976 Atoiants et al. ..... 422/310
4,127,263 A * 11/1978 Wenthe ..... 271/96
4,957,283 A * 9/1990 Kist ..... 271/90
5,014,748 A * 5/1991 Nogami et al. ..... 137/625.65
5,391,051 A 2/1995 Sabatier et al.
5,833,231 A * 11/1998 Schreiner ..... 271/197
6,454,259 B1 * 9/2002 Madsen et al. ..... 271/276
7,143,786 B2 * 12/2006 Romero ..... 137/606
2003/0075855 A1 * 4/2003 Andreyka et al. ..... 271/94
2004/0075209 A1 * 4/2004 Horiuchi ..... 271/98
2006/0086923 A1 * 4/2006 Shank et al. ..... 251/198
2009/0108224 A1 * 4/2009 Clasen et al. ..... 251/315.04
2010/0207315 A1 * 8/2010 Todoriki et al. ..... 271/94
2011/0042592 A1 * 2/2011 Elliott et al. ..... 251/120
2011/0094244 A1 * 4/2011 Xu ..... 62/6
2011/0101599 A1 * 5/2011 Hiramitsu et al. ..... 271/96
2011/0227276 A1 * 9/2011 Asari et al. ..... 271/90

FOREIGN PATENT DOCUMENTS

JP 61-156772 U 9/1986

OTHER PUBLICATIONS

Korean Office Action dated Dec. 26, 2011.

* cited by examiner

*Primary Examiner* — Jeremy R Severson
(74) *Attorney, Agent, or Firm* — Pillsbury Winthrop Shaw Pittman, LLP

(57) ABSTRACT

A valve device is provided with a first block connected to an upstream-side suction tube that is connected to a negative-pressure chamber, a second block connected to a downstream-side suction tube that is connected to a pump, first and second shielding plates rotatably interposed between the first and second blocks, and servo motors for rotating the shielding plates. Each of the shielding plates has a plurality of air passing holes, and are rotated in opposite directions.

17 Claims, 15 Drawing Sheets

VALVE DEVICE AND PAPER SHEET PICKUP APPARATUS

CROSS-REFERENCE TO RELATED APPLICATIONS

This application is based upon and claims the benefit of priority from prior Japanese Patent Application No. 2009-190308, filed Aug. 19, 2009, the entire contents of which are incorporated herein by reference.

BACKGROUND OF THE INVENTION

1. Field of the Invention

The present invention relates to a valve device for circulating and interrupting a fluid, and more particularly, to a paper sheet pickup apparatus for picking up sheets of paper one by one by attaching each sheet to a belt using a suction force.

2. Description of the Related Art

There is a conventional standard paper sheet pickup apparatus, in which a belt with holes runs along mail matters to attach thereon each mail matter by drawing each mail matter through the holes of the belt using a suction nozzle provided near the reverse side of the belt, thereby picking up the mail matters one by one (see, for example, U.S. Pat. No. 5,391,051). This apparatus comprises a solenoid valve interposed between the suction nozzle and a vacuum tank.

When operating the apparatus to pick up mail matters, the belt runs, and each mail matter is attached to the belt by the suction force of the suction nozzle that is generated when the solenoid valve is open. To sequentially pick up mail matters, the solenoid valve is periodically closed in accordance with the pickup timing of each mail matter, thereby forming a gap between a currently picked up mail matter and a mail matter to be subsequently picked up.

FIGS. 23 and 24 are schematic views illustrating a conventional solenoid valve 100. FIG. 23 shows a state in which the solenoid valve 100 is open, and FIG. 24 shows a state in which the solenoid valve 100 is closed.

In general, the solenoid valve 100 comprises a coil 104 for axially moving a substantially cylindrical plunger 102, a chamber 106 (shown only in FIG. 23) containing the plunger 102, and two holes 108*a* and 109*a* formed in the bottom of the chamber 106, through which two pipes 108 and 109 are connected to the chamber 106. When using the solenoid valve 100 in the apparatus disclosed in the above-mentioned US patent, the two pipes 108 and 109 are connected to respective suction nozzles and vacuum tanks.

When opening the solenoid valve 100, the coil 104 is excited to pull the plunger 102 out of the chamber 106 to make the two holes 108*a* and 109*a* communicate with each other via the chamber 106. In contrast, when closing the solenoid valve 100, the excitation of the coil 104 is interrupted to thereby push the plunger 102 into the chamber 106 and block the two holes 108*a* and 109*a*, thereby blocking a fluid path 110 that connects the pipes 108 and 109.

The solenoid valve 100 is opened and closed by axially moving the plunger 102. Therefore, great inertia occurs when opening/closing the solenoid valve 100. In particular, when the diameter of the pipes 108 and 109 connected to the solenoid valve 100 is increased to increase the flow of air, it is necessary to also increase the diameter of the plunger 102 for blocking the holes 108*a* and 109*a*. In this case, greater inertia will occur accordingly.

Further, when opening the solenoid valve 100, much time is required until the pressure in the chamber 106 reaches a preset value after the coil 104 is excited to move the plunger 102 and introduce air into the chamber 106. Thus, the response rate of the solenoid valve 100, i.e., the rate of starting the circulation of air after the excitation of the coil 104, is low. Similarly, when closing the solenoid valve 100, the moving rate of the plunger 102 is low since the plunger 102 is pushed into the chamber 106 against air of the preset pressure. Namely, the response rate of the conventional solenoid valve 100 is low both when the coil 104 is excited, and when the excitation of the coil 104 is stopped.

This being so, if the solenoid valve 100 is used between the suction nozzle and the vacuum tank employed in the sheet (mail matter) pickup apparatus disclosed in the above-mentioned US patent, the mail matter pickup rate will inevitably be low because of the low response rate of the solenoid valve 100 itself.

Further, if the solenoid valve 100 is used in the sheet (mail matter) pickup apparatus disclosed in the above-mentioned US patent, it will be difficult to attach, by suction force, a relatively large and heavy mail matter on the belt with holes. Namely, when the solenoid valve 100 assumes the open state shown in FIG. 23, it is necessary to circulate air through a fluid passage bent at several points. In this case, the passing resistance of the air is not small, and hence it is difficult to increase the flow rate. This makes it difficult to draw a relatively large amount of air through the suction nozzle, i.e., difficult to attach a relatively heavy mail matter on the belt by suction force.

BRIEF SUMMARY OF THE INVENTION

It is an object of the present invention to provide a valve device capable of circulating a relatively large amount of fluid and interrupting the circulation at high response rate.

It is another object of the present invention to provide a paper sheet pickup apparatus capable of easily picking up a relatively heavy paper sheet and picking up sheets of paper at high pickup rate.

In accordance with an aspect of the invention, there is provided a valve device comprising: a first shielding plate movable across a fluid passage for passing a fluid therethrough, the first shielding plate including a first fluid passing hole which overlaps with the fluid passage when the first shielding plate is moving; a second shielding plate adjacent to the first shielding plate, movable across the fluid passage and including a second fluid passing hole which overlaps with the fluid passage when the second shielding plate is moving; and a driving unit configured to make the first and second shielding plates cooperate with each other to close and open the fluid passage.

In the above structure, the fluid passage can instantly be opened simply by angularly moving the first and second shielding plates, and hence circulation of a relatively large amount of fluid can be started immediately after the fluid passage is opened. Thus, the valve device of the invention is excellent in response rate, and hence can instantly circulate and block a relatively large amount of fluid.

In accordance with another aspect of the invention, there is provided a valve device comprising: a first shielding plate rotatable across a first fluid passage for passing a fluid therethrough, and across a second fluid passage separate from the first fluid passage, the first shielding plate including a plurality of first fluid passing holes which overlap with the first and second fluid passages when the first shielding plate is rotating; a second shielding plate adjacent to the first shielding plate, rotatable across the first and second fluid passages and including a plurality of second fluid passing holes which overlap with the first and second fluid passages when the second shielding plate is rotating; and a driving unit configured to make the first and second shielding plates cooperate with each other to close and open the first and second fluid passages.

In accordance with yet another aspect of the invention, there is provided a paper sheet pickup apparatus comprising: an input unit configured to receive a plurality of paper sheets accumulated; a pickup member including a suction hole and configured to run along one of accumulated paper sheets, the one paper sheet being positioned at a most downstream side with respect to a direction of accumulation; a negative-pressure generating unit configured to draw air through the suction hole from a reverse side of the pickup member, thereby generating negative pressure on a surface of the pickup member to attach thereon the one paper sheet; a suction unit connected to the negative-pressure generating unit via a fluid passage; and a valve device provided across the fluid passage, wherein the valve device comprises: a first shielding plate movable across the fluid passage, and including a first fluid passing hole which overlaps with the fluid passage when the first shielding plate is moving; a second shielding plate adjacent to the first shielding plate, movable across the fluid passage, and including a second fluid passing hole which overlaps with the fluid passage when the second shielding plate is moving; and a driving unit configured to make the first and second shielding plates cooperate with each other to close and open the fluid passage.

In the invention constructed as above, a large amount of air can instantly be drawn from the negative-pressure chamber when picking up a paper sheet, thereby instantly reducing the internal pressure of the negative-pressure chamber. Accordingly, a relatively heavy paper sheet can easily be picked up, which enables high rate pickup of paper sheets.

In accordance with yet further aspect of the invention, there is provided a paper sheet pickup apparatus comprising: an input unit configured to receive a plurality of paper sheets accumulated; a pickup member including a suction hole and configured to run along one of accumulated paper sheets, the one paper sheet being positioned at a most downstream side with respect to a direction of accumulation; a negative-pressure generating unit configured to draw air through the suction hole from a reverse side of the pickup member, thereby generating negative pressure on a surface of the pickup member to attach thereon the one paper sheet; a suction unit connected to the negative-pressure generating unit via a first fluid passage; and a valve device provided across the first fluid passage and across a second fluid passage, wherein the valve device comprises: a first shielding plate rotatable across the first and second fluid passages, and including a plurality of first fluid passing holes which overlap with the first and second fluid passages when the first shielding plate is rotating; a second shielding plate adjacent to the first shielding plate, rotatable across the first and second fluid passages and including a plurality of second fluid passing holes which overlap with the first and second fluid passages when the second shielding plate is rotating; and a driving unit configured to make the first and second shielding plates cooperate with each other to close and open the first and second fluid passages.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the invention will be described in detail with reference to the accompanying drawings.

Figure 1:
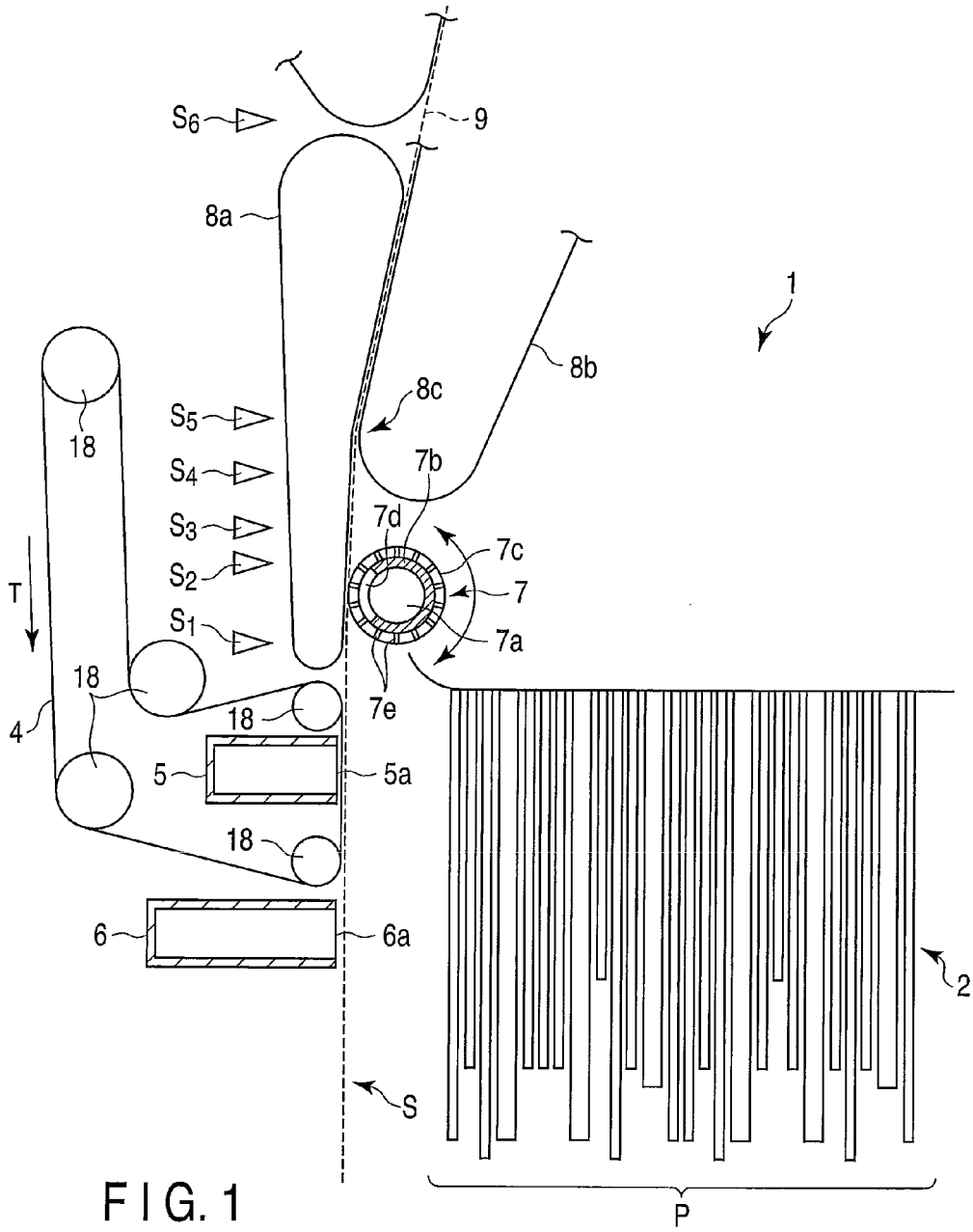
FIG. 1 is a schematic plan view illustrating a paper sheet pickup apparatus, according to the invention, seen from above.
Figure 2:
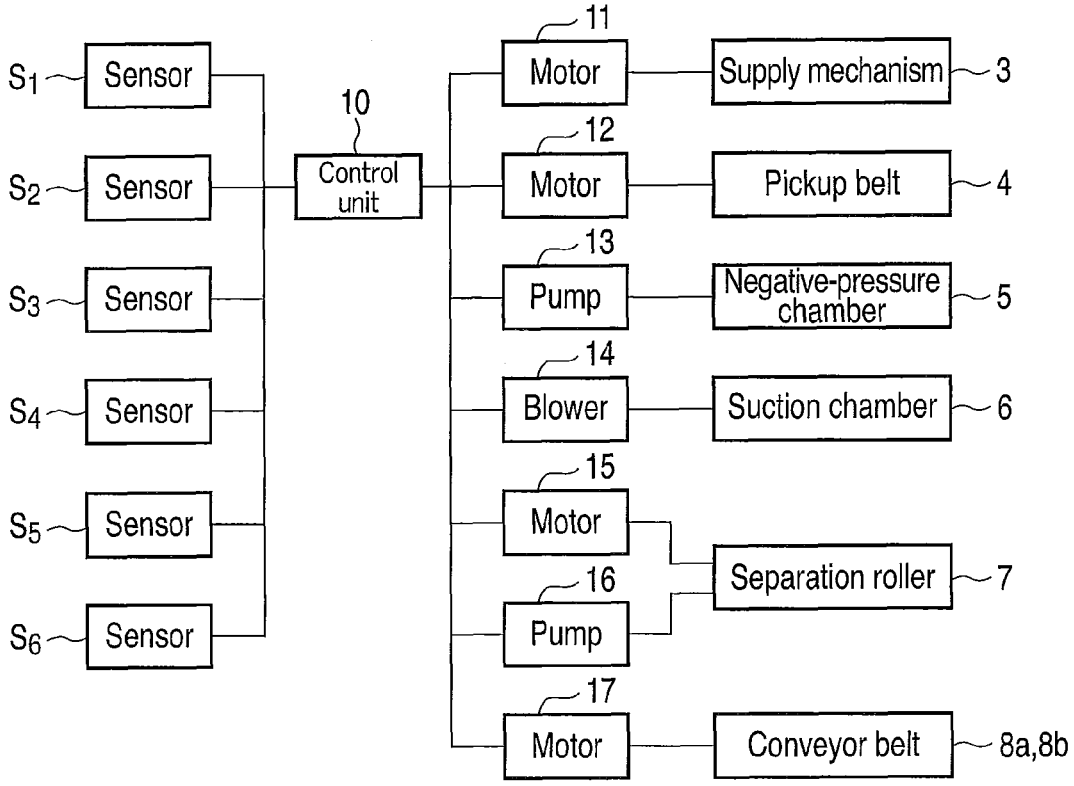
FIG. 2 is a block diagram illustrating a control system for controlling the operation of the paper sheet pickup apparatus shown in FIG. 1.

FIG. 1 is a schematic plan view illustrating a paper sheet pickup apparatus 1 (hereinafter referred to simply as "pickup apparatus 1"), according to the invention, seen from above. FIG. 2 is a block diagram illustrating a control system for controlling the operation of the pickup apparatus 1.

The pickup apparatus 1 comprises an input unit 2, a supply mechanism 3, a pickup belt 4 (pickup member), a negative-pressure chamber 5 (negative-pressure generator), a suction chamber 6, a separation roller 7, conveyor belts 8*a* and 8*b*, a plurality of sensors S1 to S6, and a control unit 10 for controlling the operation of the entire apparatus.

The control unit 10 is connected to the sensors S1 to S6, a motor 11 for operating a floor belt or a backup plate (not shown) incorporated in the supply mechanism 3, a motor 12 for running the pickup belt 4 in the direction indicated by arrow T, a pump 13 (suction unit) for drawing air from the negative-pressure chamber 5, a blower 14 for drawing air from the suction camber 6, a motor 15 for imparting separation torque to the separation roller 7, a pump 16 for generating negative pressure around the periphery of the separation roller 7, and a motor 17 for running the conveyor belts 8*a* and 8*b*.

In the input unit 2, a plurality of paper sheets P are input in an accumulated and upright state. The paper sheets P accumulated in the input unit 2 are moved to one side (the left side in FIG. 1) by the supply mechanism 3, and the front paper sheet P (the leftmost sheet in FIG. 1) is moved to a pickup position S. Whenever the front paper sheet P moved to the pickup position S is picked up, the supply mechanism 3 operates to thereby move the subsequent sheet to the pickup position S.

The pickup belt 4 runs endlessly around a plurality of pulleys. Part of the pickup belt 4 is brought into contact with the paper sheet P at the pickup position S, and runs at a constant rate in a direction parallel to the surface of the paper sheet P, i.e., in the pickup direction T. The negative-pressure chamber 5 faces the inside (reverse side) of the belt 4, and faces the pickup position S with the pickup belt 4 interposed therebetween.

Figure 3:
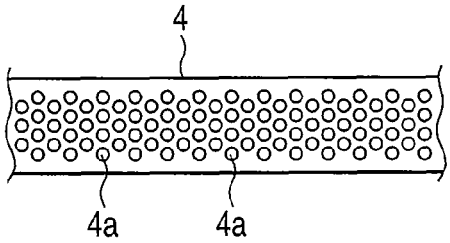
FIG. 3 is a partially enlarged view illustrating a pickup belt incorporated in the paper sheet pickup apparatus shown in FIG. 1.

As shown in FIG. 3, a plurality of suction holes 4*a* are formed in the pickup belt 4. The negative-pressure chamber 5 has an opening 5*a* facing the reverse side of the pickup belt 4. When the pickup belt 4 is run to draw air from the negative-pressure chamber 5, the pressure in the chamber 5 is reduced, whereby negative pressure is applied to the paper sheet P positioned at the pickup position S through the suction holes 4*a*. As a result, the paper sheet P is attached to the surface of the belt 4 by suction force. The paper sheet P attached to the pickup belt 4 is picked up from the pickup position S in accordance with the running of the belt 4.

The paper sheet P picked up from the pickup position S is conveyed by a conveyor path 9 upward in FIG. 1, and is transferred to a conveyor section formed of conveyor belts 8*a* and 8*b*. The sensors S1 to S6 provided along the conveyor path 9 are transmission-type optical sensors (only one of the components of each sensor is shown), and used to detect whether the optical axis of each sensor is crossed by the paper sheet P (when the optical axis is crossed by the paper sheet P, the sensor output has a "dark" level, whereas when there is no sheet that crosses the optical axis, the sensor output has a "bright" level). Namely, each of the sensors S1 to S6 detects the front and rear ends of each paper sheet P with respect to the direction of conveyance.

The suction chamber 6 is provided upstream (at the lower position in FIG. 1) of the pickup belt 4 with respect to the direction in which each paper sheet P is picked up, and has an opening 6*a* opposing the pickup position S. When the blower 14 is operated, air is drawn through the opening 6*a* of the suction chamber 6, thereby producing an air flow at the pickup position S. The air flow functions to quickly draw each paper sheet P received in the inlet unit 2 and fed to the above-mentioned one side of the inlet unit 2 (the most downstream side of the inlet unit 2 with respect to the direction of accumulation).

The separation roller 7 is provided downstream of the pickup position S with respect to the paper sheet pickup direction (i.e., at the upper side in FIG. 1), and faces the pickup belt 4 with the conveyor path 9 interposed therebetween. The separation roller 7 includes a substantially cylindrical core 7*b* with a chamber 7*a* defined therein, and a substantially cylindrical sleeve 7*c* rotatably provided on the outer periphery of the core 7*b*. The core 7*b* has an opening 7*d* fixedly opening to the conveyor path 9. The sleeve 9*c* has a plurality of suction holes 7*e*. With this structure, when the pump 16 is operated to draw air from the chamber 7*a* of the core 7*b*, negative pressure occurs at the periphery of the separation roller 7 via the suction holes 7*e* of the sleeve 7*c* that rotates around the core 7*b*.

Namely, by applying, to the sleeve 7*c*, separation torque that exerts in a direction opposite to the paper sheet pickup direction, using the motor 15, and producing negative pressure around the outer periphery of the sleeve 7*c*, using the pump 16, a few paper sheets P picked up unintentionally simultaneously with a leading paper sheet P when the leading paper sheet is picked up from the pickup position S can be separated from the leading paper sheet.

The conveyor belt 8*a*, an endless belt, is tensioned (at the left side in FIG. 1), opposing the separation roller 7 with the conveyor path 9 interposed therebetween. Further, the conveyor belt 8*b*, an endless belt, is tensioned, opposing the conveyor belt 8*a* with the conveyor path 9 interposed therebetween. Thus, the conveyor path 9 located downstream of the separation roller 7 is defined between the two conveyor belts 8*a* and 8*b*. The front end of each paper sheet P picked up from the pickup position S is nipped by the nip 8*c* of the conveyor belts 8*a* and 8*b*, and conveyed to the downstream side by the conveyor belts 8*a* and 8*b* (conveyor section).

A description will now be given of the operation of feeding, one by one onto the conveyor path 9, a plurality of paper sheets P received in the inlet unit 2.

When a plurality of paper sheets P are fed from the inlet unit 2 to the pickup apparatus 1, they are sequentially supplied by the supply mechanism 3 to the pickup position S, and are drawn by the pickup belt 4 and fed onto the conveyor path 9. The paper sheets P conveyed through the conveyor path 9 are monitored in conveyor position and state by the control unit 10 via the sensors S1 to S6.

When each paper sheet P is picked up, the pump 13 is operated to draw air from the negative pressure chamber 5, thereby generating negative pressure on the surface of the pickup belt 4. Further, an air flow directed to the pickup position S is constantly applied by the suction chamber 6 to the paper sheet P earliest accumulated in the inlet unit 2 (i.e., the leftmost one in FIG. 1). Namely, the earliest accumulated paper sheet is quickly positioned at the pickup position, and picked up by the pickup belt 4 by a suction force.

The paper sheet P picked up from the pickup position S is guided to the nip 8*c* of the conveyor belts 8*a* and 8*b*, and then guided to a further downstream position, with the front end of the paper sheet nipped by the nip 8*c*. The fact that the picked paper sheet P has reached the nip 8*c* is detected when the output of the sensor S5 is changed from the "bright level" to the "dark level." At this time, the running rate of the conveyor belts 8*a* and 8*b* is set to a value slightly higher than that of the pickup belt 4, which means that the paper sheet P is pulled out by the conveyor belts 8*a* and 8*b*.

When one or more paper sheets P are picked up simultaneously with a paper sheet P firstly fed to the pickup position S, they are separated from the latter sheet by the separation roller 7. At this time, negative pressure is produced on the periphery of the separation roller 7, and separation torque is exerted on the sleeve 7*c* in a direction opposite to the pickup direction. When a single paper sheet P is normally picked up, the sleeve 7*c* of the separation roller 7 is rotated in the pickup direction. In contrast, when two or more paper sheets are simultaneously picked up, the sleeve 7*c* is rotated in a direction opposite to the above, whereby the second and later paper sheets are returned and separated from the first paper sheet.

When superposed paper sheets P are separated and fed to the conveyor path 9 one by one, as described above, a gap is formed between the adjacent paper sheets P by executing on-off control of the negative pressure in the negative-pressure chamber 5, or by intermittently running the pickup belt 4. The gap is determined in accordance with the processing rate of paper sheets P in a processing unit (which is not shown or described) connected to the conveyor path 9 and located downstream of the pickup apparatus 1. In addition to this structure, or alternatively, the gap is determined in accordance with the switching rate of a gate (not shown) provided downstream of the conveyor path 9.

For instance, to enhance the processing efficiency of the processing unit located downstream and impart a sufficient processing time, it is desirable to control the gap between adjacent paper sheets to a desired length. However, in the method of forming a gap by intermittently operating the pickup belt 4, it is difficult to highly accurately control the times required for accelerating and decelerating the belt, and hence slippage may occur between the belt and each paper sheet when the belt is accelerated or decelerated.

Further, to control the gap between adjacent paper sheets, another method is possible, in which the above-mentioned conventional solenoid valve is provided across the line connecting the pump 13 to the negative-pressure chamber 5 to open/close the solenoid valve, thereby on/off controlling the negative pressure in the negative-pressure chamber 5 and hence controlling the gap. In this method, however, since the response rate of the solenoid valve itself is low, it is difficult to accurately adjust the gap between adjacent paper sheets to a desired value.

To accurately adjust the gap, the inventors of the present invention have developed a valve device that has an extremely high response rate, can circulate a large amount of air, and can instantly circulate air and stop the circulation of the air. Various embodiments of the valve device will now be described.

Figure 4:
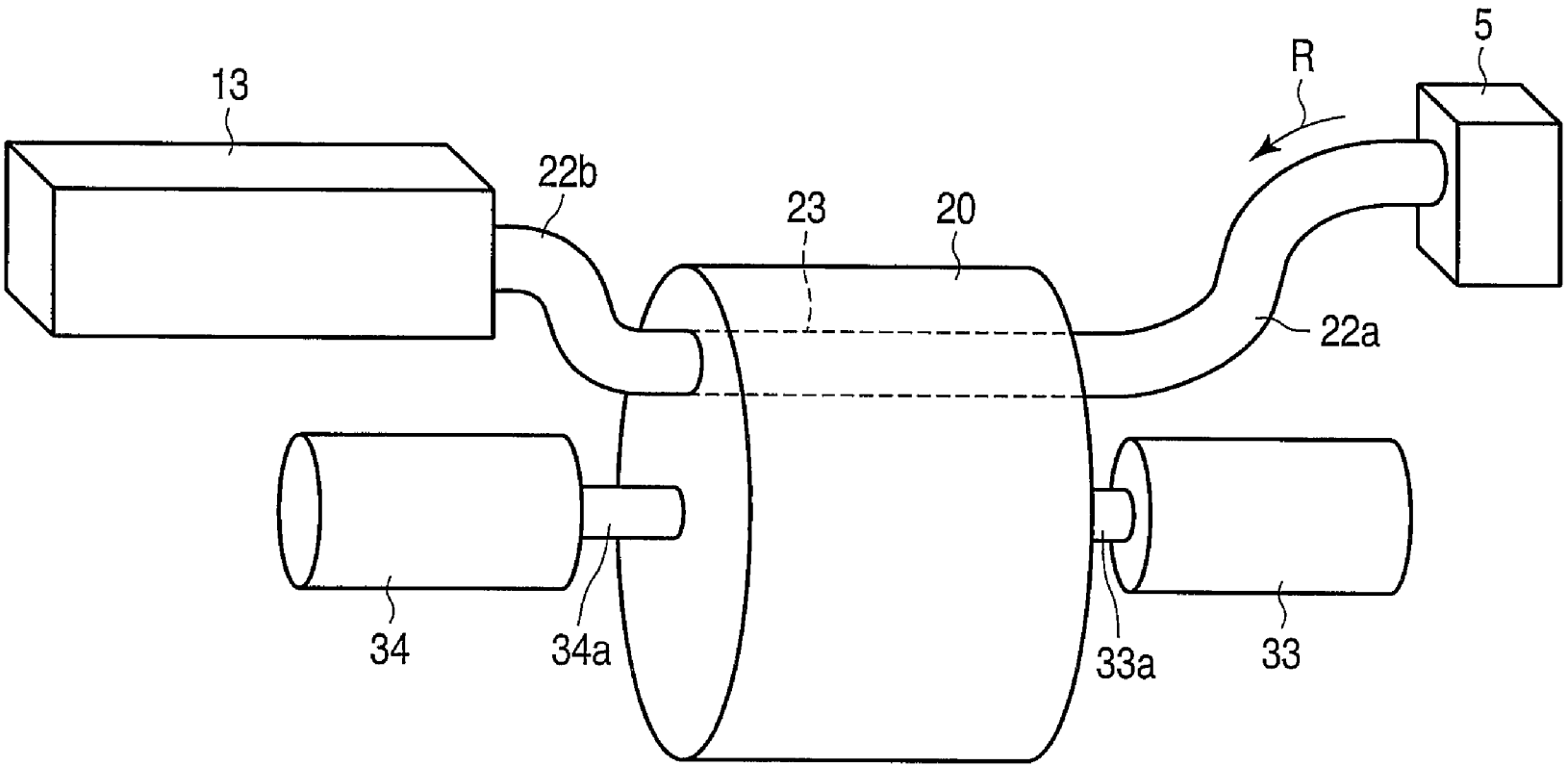
FIG. 4 is a schematic perspective view illustrating a valve device according to a first embodiment and incorporated in the paper sheet pickup apparatus shown in FIG. 1 between a negative-pressure chamber and a pump that are incorporated in the same apparatus.
Figure 5:
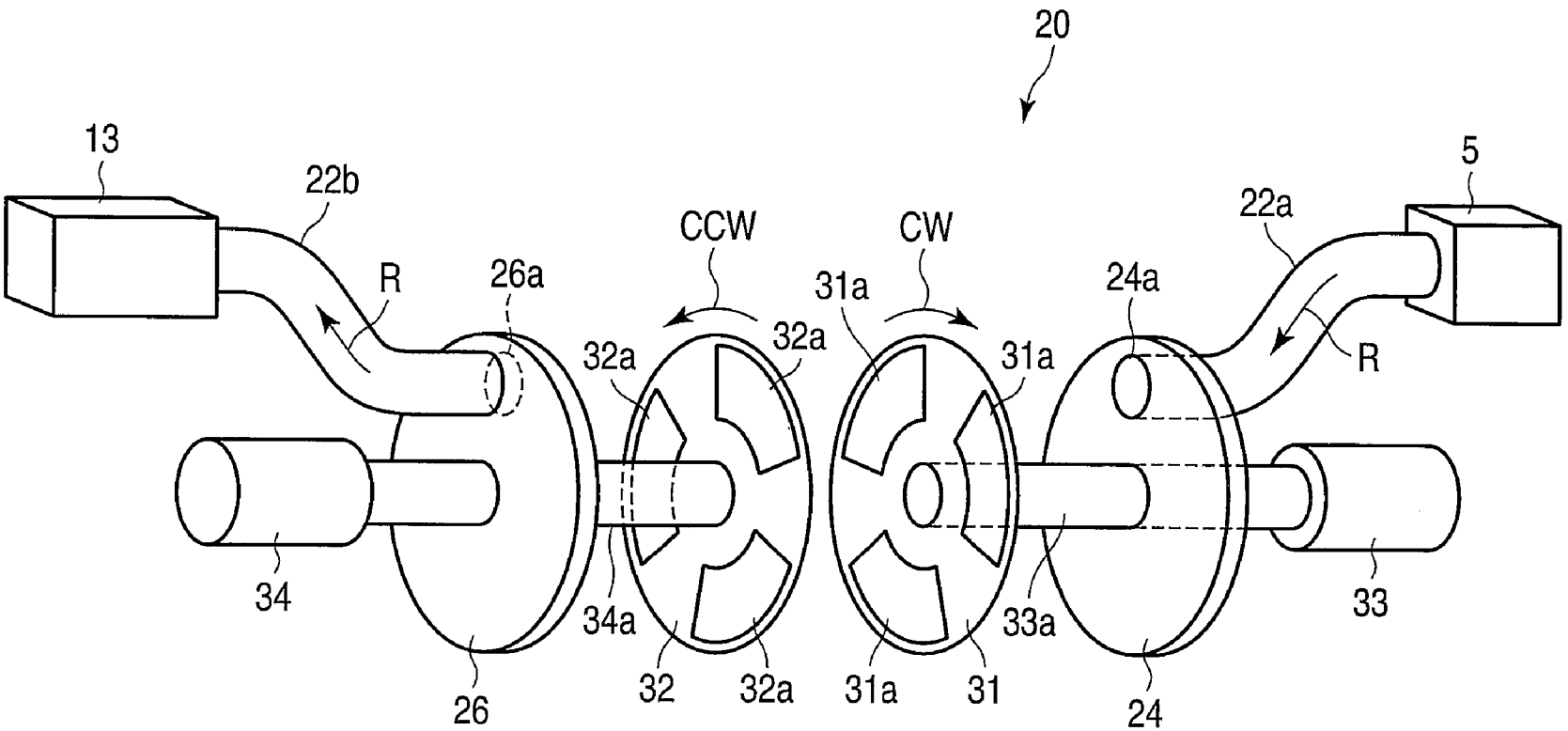
FIG. 5 is an exploded perspective view illustrating the valve device shown in FIG. 4.

FIG. 4 is a schematic perspective view illustrating a valve device 20 according to. a first embodiment. FIG. 5 is an exploded perspective view illustrating the internal structure of the valve device shown in FIG. 4.

The valve device 20 is provided across a suction tube 22 that connects the negative-pressure chamber 5 and the pump 13. As shown in FIGS. 4 and 5, in the direction (indicated by arrow R) in which air flows when the pump 13 operates, the suction tube 22 is divided into an upstream-side suction tube 22*a* connected to the negative-pressure chamber 5 located upstream of the valve device 20, and a downstream-side suction tube 22*b* connected to the pump 13 located downstream of the valve device 20.

As shown in FIG. 5, the valve device 20 comprises a first substantially disc-shaped block 24 connected to an end of the upstream-side tube 22*a* away from the negative-pressure chamber 5, a second substantially disc-shaped block 26 connected to an end of the downstream-side tube 22*b* away from the pump 13, first and second substantially disc-shaped shielding plates 31 and 32, and two servo motors 33 and 34 for independently rotating the shielding plates 31 and 32, respectively.

The two servo motors 33 and 34 function as driving units of the present invention, and are connected to the control unit 10 of the pickup apparatus described above. The servo motors 33 and 34 are provided outside the first and second blocks 24 and 26, respectively. Although the first embodiment employs the two servo motors 33 and 34 for independently rotating the two shielding plates 31 and 32, the two shielding plates 31 and 32 may be rotated by a single driving unit (not shown).

As indicated by the broken line in FIG. 4, the suction tube 22 comprising the upstream and downstream tubes 22*a* and 22*b* defines an air passage 23 through the valve device 20. The first and second blocks 24 and 26 and the first and second shielding plates 31 and 32 are arranged coaxially and adjacent to each other, with their axes set substantially parallel to the air passage 23. Namely, although FIG. 5 shows the four disk-shaped members 24, 26, 31 and 32 in an axially separate state for facilitating the explanation, they are actually axially adjacent to each other as shown in FIG. 4.

The first and second shielding plates 31 and 32 are arranged rotatable (angularly movable) on the plane extending across the air passage 23. Further, the rotary shaft of the servo motor 33 is extended through the central portions of the first and second block 24 and the first shielding plate 31, and the rotary shaft of the servo motor 34 is extended through the central portions of the second block 26 and the second shielding plate 32. The rotary shafts of the servo motors 33 and 34 are arranged coaxial.

The first and second shielding plates 31 and 32 are independently rotated in opposite directions by the servo motors 33 and 34 as indicated by arrows CW and CCW, respectively. More specifically, the first shielding plate 31 is rotated clockwise (in the direction indicated by the arrow CW) when seen from the left side in FIG. 5. Similarly, the second shielding plate 32 is rotated counterclockwise (in the direction indicated by the arrow CCW) when seen from the left side in FIG. 5.

A communication hole 24*a* is formed through the first block 24 so that it communicates with the upstream-side tube 22*a*, and a communication hole 26*a* is formed through the second block 26 so that it communicates with the downstream-side tube 22*b*. The communication holes 24*a* and 26*a* are formed at preset corresponding positions away from the axes of rotation of the first and second blocks 24 and 26, respectively. The communication holes 24*a* and 26*a* are formed coaxial, facing each other, to define the opposite ends of the aforementioned air passage 23.

A plurality of (three in the embodiment) air passing holes 31*a* (first air passing holes) and a plurality of (three in the embodiment) air passing holes 32*a* (second air passing holes) are formed in the first and second shielding plates 31 and 32, respectively. These air passing holes 31*a* and 32*a* rotate (angularly move) in accordance with the rotation of the first and second shielding plates 31 and 32. In the first embodiment, the air passing holes 31*a* and 32*a* are of a fan shape having diametrically extending edges. Namely, by virtue of this shape, the air passing holes 31*a* and 32*a* overlap with the communication holes 24*a* and 26*a* of the first and second blocks 24 and 26, i.e., overlap with the air passage 23 of the suction tube 22 for a relatively long time, while the shielding plates 31 and 32 are rotated.

Referring now to FIGS. 6 to 15, a description will be given of the operation of the valve device 20 constructed as above.

Figure 14:
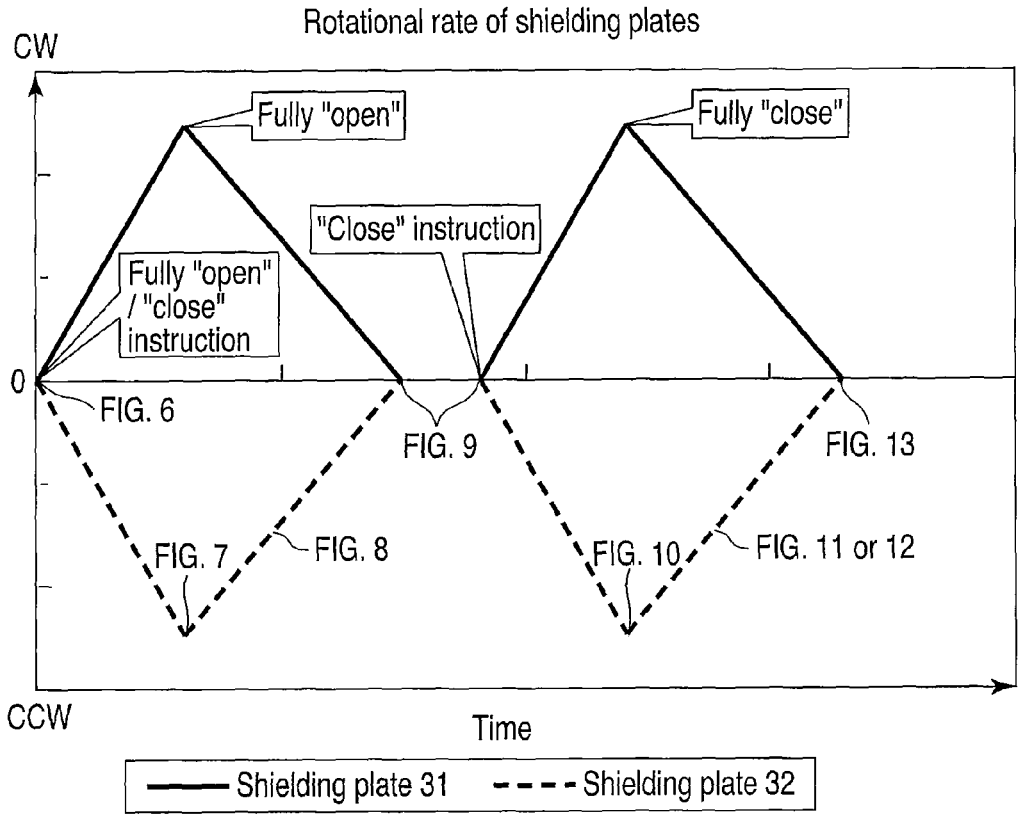
FIG. 14 is a graph indicating changes in the rotational rate of each of two shielding plates, which are assumed when the valve device operates as shown in FIGS. 6 to 13.
Figure 15:
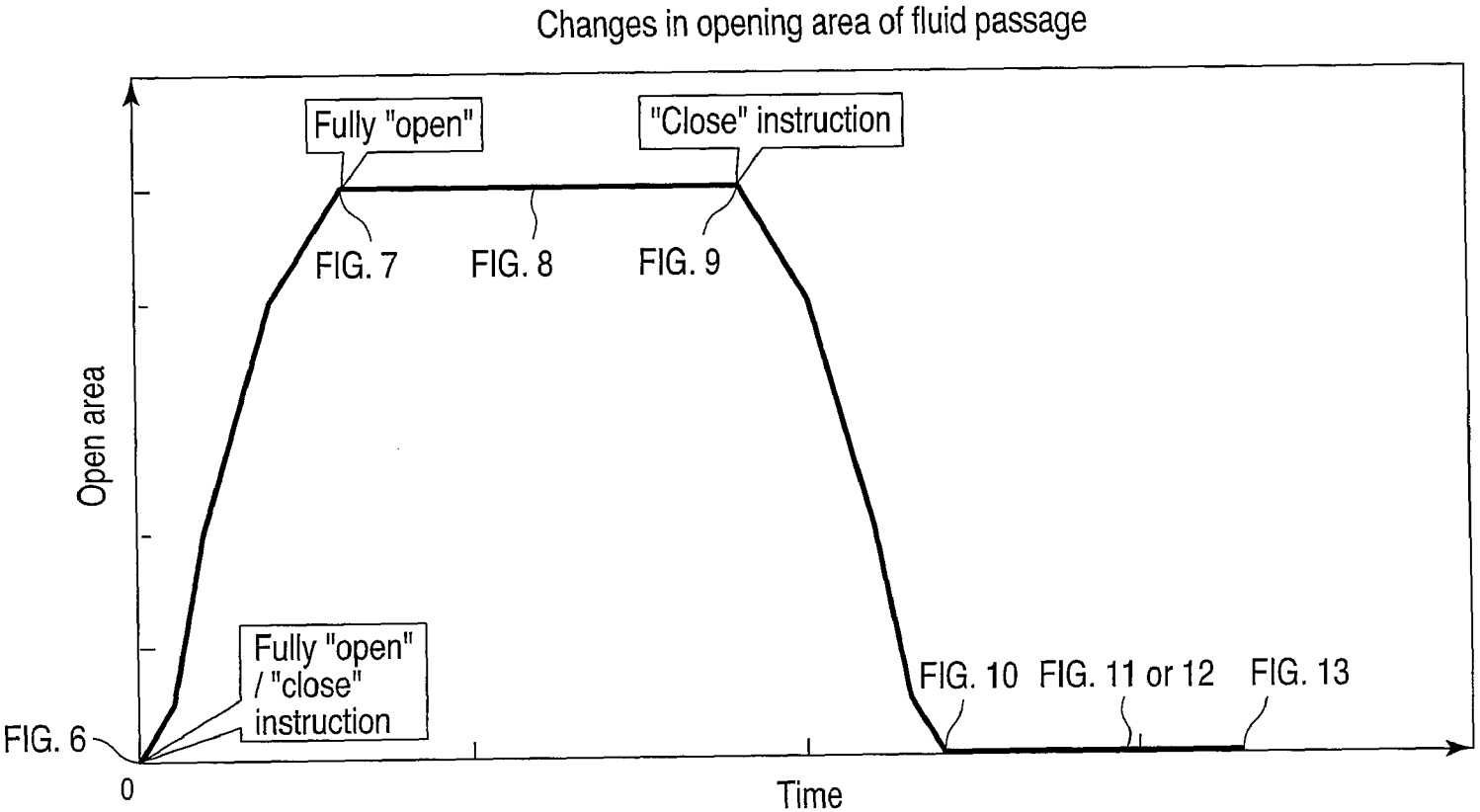
FIG. 15 is a graph indicating changes with time in the open area of a fluid passage, which are assumed when the valve device operates as shown in FIGS. 6 to 13.

FIGS. 6 to 13 are views useful in explaining the opening/closing control of the air passage 23 performed by rotating the two shielding plates 31 and 32. FIG. 14 is a graph useful in explaining changes in the rotational rate of each of the shielding plates 31 and 32 associated with the operations shown in FIGS. 6 to 13. FIG. 15 is a graph illustrating changes with time in the open area of the air passage 23 associated with the operations shown in FIGS. 6 to 13. Note that for facilitating the description, FIGS. 6 to 13 show only essential structural elements of the valve device 20.

Figure 6:
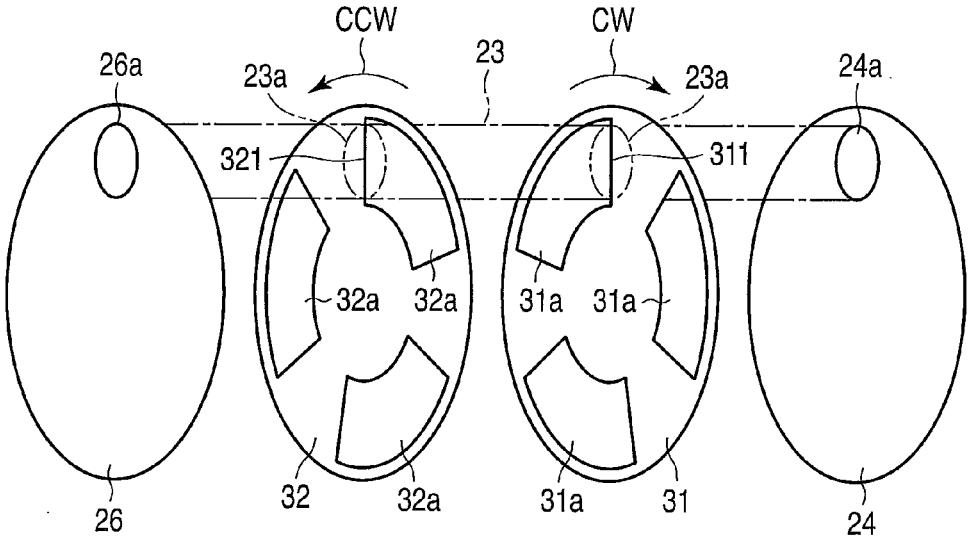
FIG. 6 is a view useful in explaining the operation of the valve device shown in FIG. 5.

FIG. 6 shows a state example in which the valve device 20 closes the air passage 23. FIGS. 6 to 13 show, using two-dot chain lines, an area 23*a* in which the air passage 23 overlaps with the shielding plates 31 and 32. In the first embodiment, the two shielding plates 31 and 32 were rotated at various rates only in the directions indicated by the arrows. Specifically, as shown in FIG. 14, the first shielding plate 31 adjacent to the first block 24 and closer to the negative-pressure chamber 5 is rotated clockwise (in the CW direction or a first direction), and the second shielding plate 32 adjacent to the second block 26 and closer to the pump 13 is rotated counterclockwise (in the CCW direction or a second direction).

In the state shown in FIG. 6, the two shielding plates 31 and 32 are stopped. This state is set as a standby state assumed before the air passage 23 is opened. In the graphs of FIGS. 14 and 15, the time at which the standby state shown in FIG. 6 is assumed is set as the origin. In this state, approx. half of the cross section of the air passage 23 is blocked (closed) by the first shielding plate 31, and the other half is blocked by the second shielding plate 32. Thus, the first and second shielding plates 31 and 32 cooperate to completely block the air passage 23.

More specifically, in the state shown in FIG. 6, the CW directional leading edge 311 of one of the air passing holes 31*a* of the first shielding plate 31 crosses the air passage 23, and the CCW directional leading edge 321 of one of the air passing holes 32*a* of the second shielding plate 32 crosses the air passage 23. In this state, it is necessary to set the two air passing holes 31*a* and 32*a* so as not to overlap with each other. However, the aforementioned leading edges 311 and 321 may slightly overlap with each other.

Figure 7:
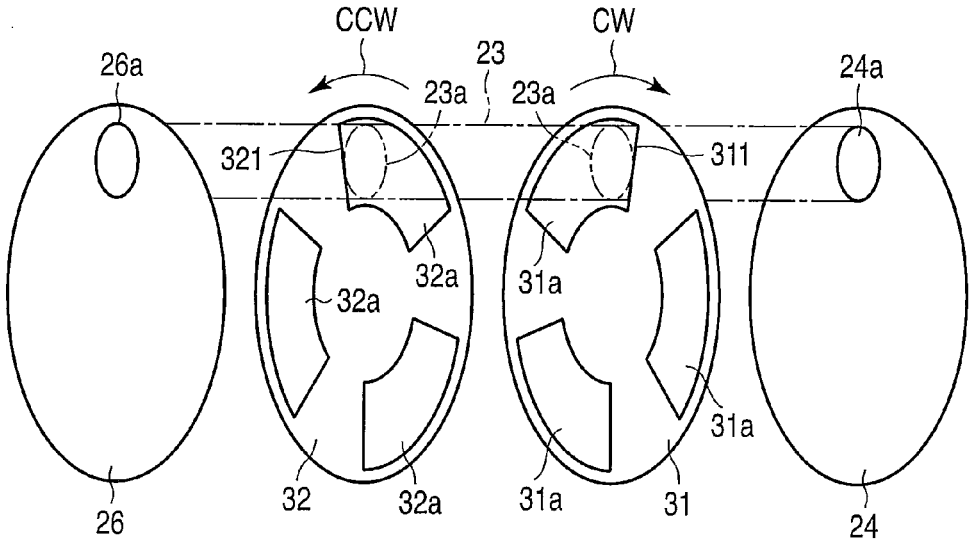
FIG. 7 is a view useful in explaining the operation of the valve device shown in FIG. 5.

If in this state, an "open" instruction is issued from the control unit 10, the shielding plates 31 and 32 are rotated in the respective directions indicated by the arrows, until the state shown in FIG. 7 is assumed. As a result, the air passage 23 is opened. More specifically, the control unit 10 monitors the outputs of the sensors S1 to S6 to determine whether a preceding paper sheet P is transferred onto the conveyor path 9, and issues the "open" instruction for attaching a subsequent paper sheet P to the pickup belt 4.

Since at this time, the control unit 10 starts to rotate the shielding plates 31 and 32 that are in the standby state shown in FIG. 6, the angular velocity of each of the shielding plates 31 and 32 is gradually increased from 0 as shown in FIG. 14. As can be understood from FIG. 14, the two shielding plates 31 and 32 start to rotate from their angular standby positions, and the air passage 23 is fully opened while the rotation of the shielding plates 31 and 32 is accelerated. Namely, in the state shown in FIG. 7, the shielding plates 31 and 32 are rotated at the highest rotational rate.

Thus, by fully opening the air passage 23 during acceleration of the shielding plates 31 and 32, the air passage 23 can be extremely quickly switched from the closed state to the open state as shown in FIG. 15, thereby increasing the response rate of the valve device 20. To this end, it is important to make the air passage 23 assume the state shown in FIG. 6 when it is in the standby state before it is open. It is also important to rotate the shielding plates 31 and 32 in different directions from their angular standby positions shown in FIG. 6.

On the other hand, if it is necessary to simultaneously open the air passage and stop the shielding plates 31 and 32, an extra time required for deceleration of the shielding plates 31 and 32 performed to stop them, after they are accelerated from their respective standby positions. This inevitably increases the time required until the air passage 23 is fully opened after an "open" instruction is issued.

Further, if the first shielding plate 31 is rotated from the position in which the front edge 311 of the air passing hole 31*a* does not cross the air passage 23, and the second shielding plate 32 is rotated from the position in which the front edge 321 of the air passing hole 32*a* does not cross the air passage 23, thereby opening the air passage 23, the angular moving distance (rotational angle) of each shielding plate 31 or 32, required to shift the air passage 23 from the open state to the closed state, becomes longer (larger). Thus, a long time will be necessary to fully open the air passage 23 after receiving the "open" instruction.

In light of the above, the first embodiment is designed such that the two shielding plates 31 and 32 start to rotate from their angular standby positions shown in FIG. 6, and the air passage 23 is fully opened while the rotation of the two shielding plates 31 and 32 is accelerated. Although in the first embodiment, the air passage 23 is fully opened during acceleration of the shielding plates 31 and 32, it is sufficient if each of the shielding plates 31 and 32 is not decelerated at least until the air passage is opened.

Figure 8:
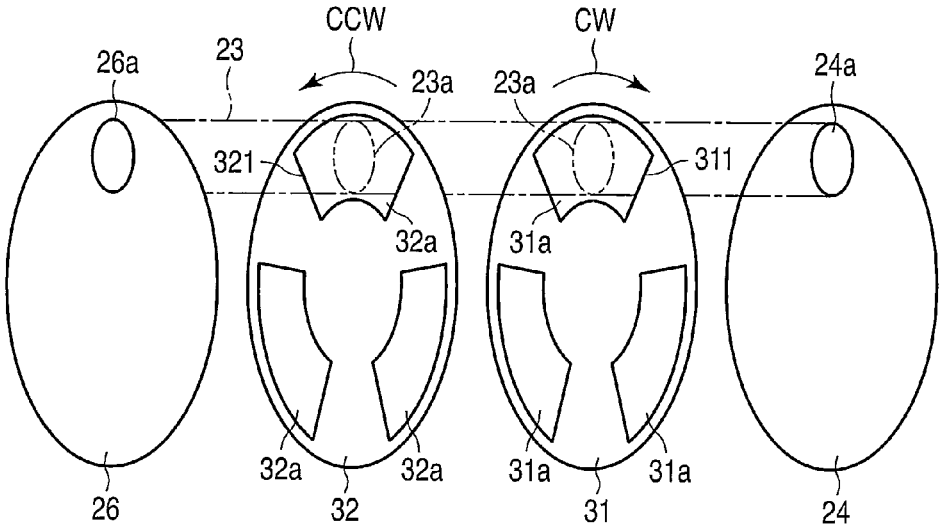
FIG. 8 is a view useful in explaining the operation of the valve device shown in FIG. 5.
Figure 9:
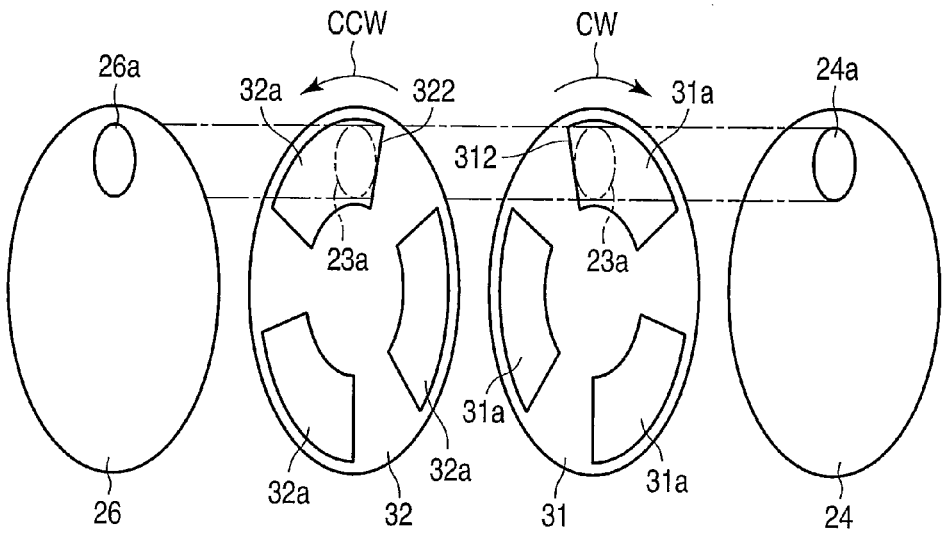
FIG. 9 is a view useful in explaining the operation of the valve device shown in FIG. 5.

After that, the control unit 10 decelerates and stops the shielding plates 31 and 32 while the state shown in FIG. 7 is shifted to the FIG. 8 state and then to the FIG. 9 state. In the first embodiment, while the state shown in FIG. 7 is shifted to the FIG. 8 state, the shielding plates 31 and 32 are decelerated and almost stopped, and while the FIG. 8 state is shifted to the FIG. 9 state, each of the shielding plates 31 and 32 is rotated slowly to another standby position shown in FIG. 9. Thus, the state shown in FIG. 9 now serves as the standby state assumed before blocking the air passage 23.

More specifically, in the standby state shown in FIG. 9, the CW directional trailing edge 312 of one of the air passing holes 31*a* of the first shielding plate 31 is adjacent to an edge portion of the air passage 23 (area 23*a*), and the CCW directional trailing edge 322 of one of the air passing hole 32*a* of the second shielding plate 32 is adjacent to another edge portion of the air passage 23 (area 23*a*) opposite to the first-mentioned edge portion. In this state, the two air passing holes 31*a* and 32*a* overlap with the air passage 23.

Figure 10:
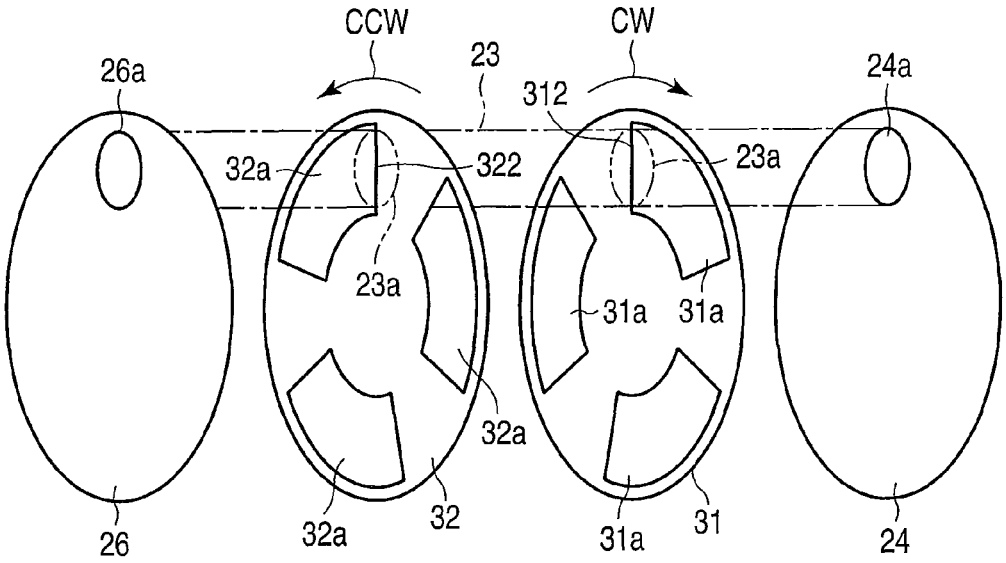
FIG. 10 is a view useful in explaining the operation of the valve device shown in FIG. 5.

When the two shielding plates 31 and 32 are rotated from the angular standby positions shown in FIG. 9 to the angular positions shown in FIG. 10 in accordance with a "close" instruction issued from the control unit 10, the air passage 23 is instantly closed. Also in this case, it is important to block the air passage 23 during acceleration of the shielding plates 31 and 32 as shown in FIG. 14, namely, the shielding plates 31 and 32 will not be decelerated. Further, at this time, the rotational angle (moving distance), through which each shielding plate 31 or 32 needs to move to completely block the air passage 23, is an extremely small angle (short distance) corresponding to the angular movements of the trailing edges 312 and 322 of the air passing holes 31*a* and 32*a* from the respective edge portions of the air passage 23 to substantially the center of the air passage 23. From this, it is understood that the air passage 23 can be blocked in a very short time.

To block the air passage 23 in a short time, it is important to stop the shielding plates 31 and 32 at the angular standby positions shown in FIG. 9 assumed before blocking the air passage 23. By establishing this standby state, the rate of the closing operation of the valve device 20 can be increased. When the state shown in FIG. 10 is assumed, the shielding plates 31 and 32 are rotated at the highest rotational rate.

Figure 11:
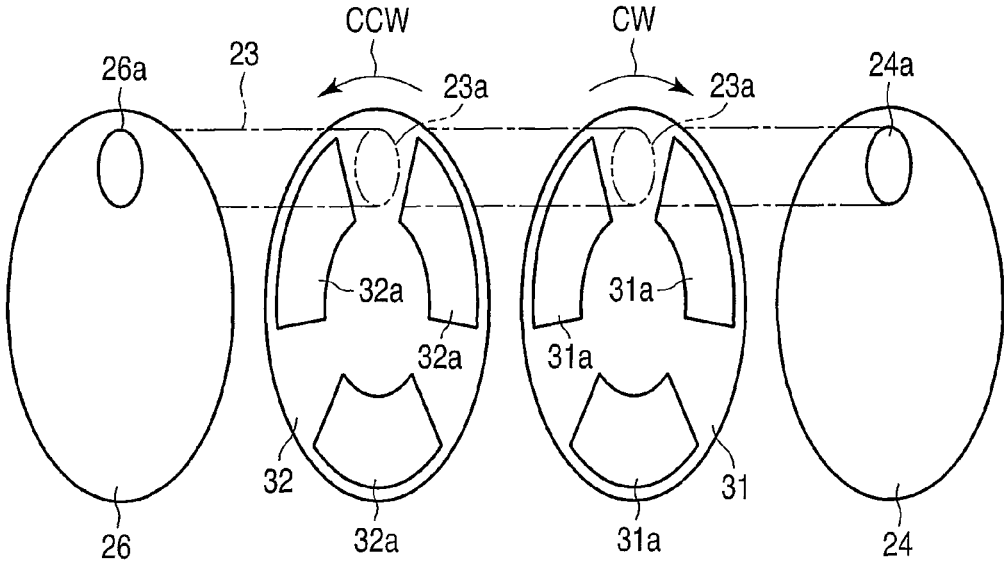
FIG. 11 is a view useful in explaining the operation of the valve device shown in FIG. 5.
Figure 12:
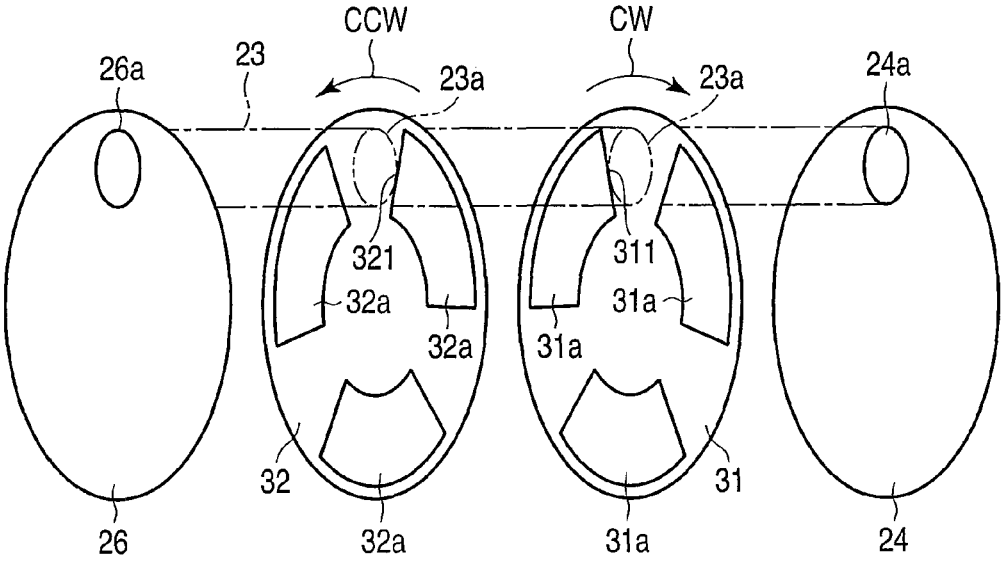
FIG. 12 is a view useful in explaining the operation of the valve device shown in FIG. 5.
Figure 13:
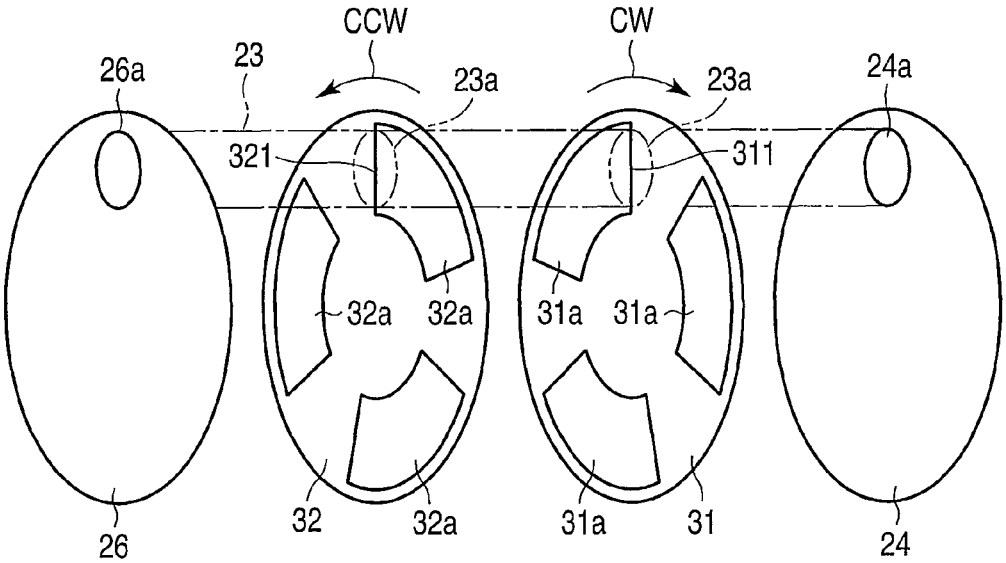
FIG. 13 is a view useful in explaining the operation of the valve device shown in FIG. 5.

Thereafter, the control unit 10 decelerates and almost stops the rotation of the shielding plates 31 and 32 while the state shown in FIG. 10 is shifted to the FIG. 11 state and then to the FIG. 12 state. After that, the control unit 10 slowly rotates the shielding plates 31 and 32 until the standby state shown in FIG. 13 (the same state shown in FIG. 6) is assumed, and stops them.

The operations shown in FIGS. 6 to 13 are repeated to control the opening and closing of the valve device 20, thereby opening and closing the suction tube 22 to apply negative pressure to each paper sheet P set at the pickup position S and attach the same to the pickup belt 4. As a result, paper sheets P are intermittently picked up to the conveyor path 9 one by one. In the case of using the valve device 20 of the first embodiment, three paper sheets P can be picked up while the shielding plates 31 and 32 are each rotated through 360°.

As described above, the valve device 20 of the first embodiment can instantly open and close the air passage 23 to enable a plurality of paper sheets P to be sequentially picked up at high rate. Further, the pickup apparatus 1 of the first embodiment, which employs the above-described valve device 20, can instantly circulate and block a large amount of air, thereby enabling even relatively heavy paper sheets P to be attached to the pickup belt 4 reliably.

If the conventional solenoid valve is used for the same purpose as the above, it is difficult to simultaneously pass therethrough a large amount of air since the solenoid valve has a significant fluid passage resistance as described above, with the result that the negative-pressure chamber 5 cannot instantly be set to negative pressure. Furthermore, if the fluid passage itself is made thicker, the inertia of the plunger will inevitably be increased, and accordingly, the response rate of the solenoid valve becomes low.

In contrast, the valve device 20 of the first embodiment can instantly open and close the air passage 23 by simply rotating the motor 27, and hence the response rate of the valve device can be easily enhanced. Further, in the valve device 20 of the first embodiment, the diameter of the air passage 23 can be set to an arbitrary value, whereby a greater amount of air can be circulated and blocked. Yet further, since the valve device 20 of the first embodiment has a structure for linearly passing air, it has almost no air passing resistance and hence can smoothly circulate a large amount of air.

Figure 16:
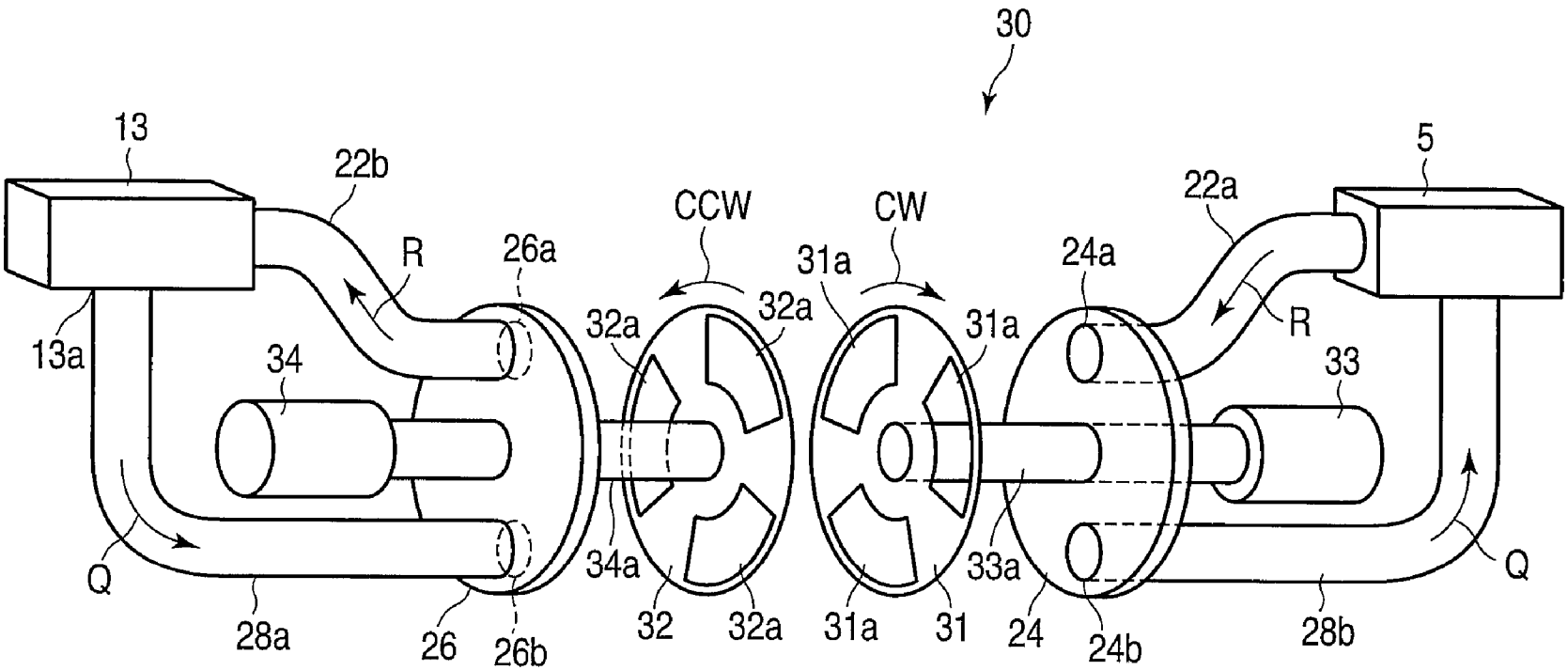
FIG. 16 is an exploded perspective view illustrating a valve device according to a second embodiment and incorporated in the paper sheet pickup apparatus shown in FIG. 1 between the negative-pressure chamber and the pump that are incorporated in the same apparatus.

FIG. 16 is an exploded perspective view illustrating a valve device 30 according to a second embodiment. The valve device 30 is provided across the suction tube 22 that connects the negative-pressure chamber 5 to the pump 13, as in the above-described first embodiment, and also across an exhaust tube 28 that connects the negative-pressure chamber 5 and the exhaust port 13*a* of the pump 13. In other words, the valve device 30 is operated to alternately open/close the suction tube 22 and the exhaust tube 28.

The exhaust tube 28 comprises an upstream-side exhaust tube 28*a* located upstream of the valve device 30 with respect to the flow direction (indicated by arrow Q) of air exhausted from the exhaust port 13*a* of the pump 13, and a downstream-side exhaust tube 28*b* located downstream of the valve device 30. The upstream-side exhaust tube 28*a* connects the exhaust port 13*a* of the pump 13 to the communication hole 26*b* of the second block 26 of the valve device 30, while the downstream-side exhaust tube 28*b* connects the negative-pressure chamber 5 to the communication hole 24*b* of the first block 24 of the valve device 30. The exhaust tube 28 defines an air passage 29 described later.

The communication hole 24*a* of the first block 24, and the communication hole 24*b* of the first block 24, which is connected to the downstream-side exhaust tube 28*b*, are formed symmetrical with respect to the rotation axis of the shielding plate 31. Similarly, the communication hole 26*a* of the second block 26, and the communication hole 26*b* of the second block 26, which is connected to the upstream-side exhaust tube 28*a*, are formed symmetrical with respect to the rotation axis of the shielding plate 32. The communication hole 26*b* is also formed coaxial with the communication hole 24*b* of the first block 24. Since the structural elements of the second embodiment other than the above-described ones are similar to those of the valve device 20 of the first embodiment, they will not be described in detail but be only denoted by corresponding reference numbers.

The operation of the valve device 30 constructed as above will be described.

For facilitating the description, FIGS. 17 to 22 only show essential parts of the valve device 30.

Figure 17:
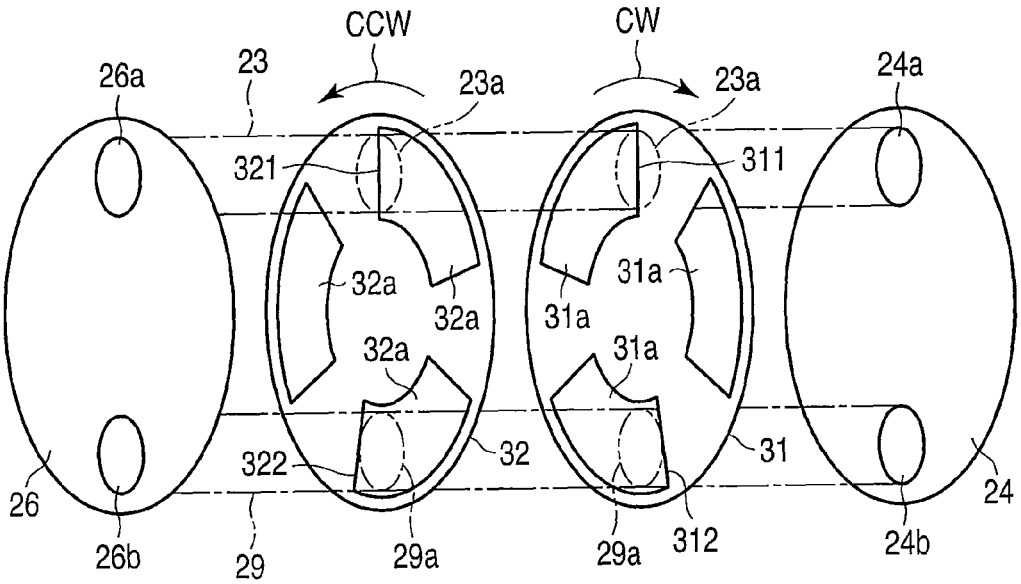
FIG. 17 is a view useful in explaining the operation of the valve device shown in FIG. 16.

FIG. 17 shows an example in which the suction tube 22 is blocked and the exhaust tube 28 is open. Namely, in the state shown in FIG. 17, the air passage 23 (first air passage) defined by the suction tube 22 is blocked (closed), and the air passage 29 (second air passage) defined by the exhaust tube 28 is open. In other words, in the FIG. 17 state, exhaust air is sent from the pump 13 to the negative-pressure chamber 6 to return the internal pressure of the chamber to the atmospheric pressure.

In the FIG. 17 state, the rotation of the two shielding plates 31 and 32 is stopped. Suppose that this state is a standby state assumed before the air passage 23 is open. This state also serves as a standby state assumed before the air passage 29 is blocked. Namely, in this state, half of the cross section of the air passage 23 is blocked by the first shielding plate 31, and the other half is blocked by the second shielding plate 32. Thus, the first and second shielding plates 31 and 32 cooperate to completely block the air passage 23. Also in this state, the other air passage 29 overlaps with the air passing hole 31*a* of the first shielding plate 31 and with the air passing holes 32*a* of the second shielding plate 32. Thus, the first and second shielding plates 31 and 32 cooperate to completely open the air passage 29.

More specifically, in the above state, the CW directional leading edge 311 of one of the air passing holes 31*a* of the first shielding plate 31 crosses the air passage 23, and the CCW directional leading edge 321 of one of the air passing holes 32*a* of the second shielding plate 32 crosses the air passage 23. In addition, the one air passing hole 31*a* does not overlap with the one air passing hole 32*a* within the cross section of the air passage 23.

Furthermore, in the above state, the CW directional trailing edge 312 of another air passing hole 31*a* of the first shielding plate 31 is adjacent to an edge portion of the air passage 29, and the CCW directional trailing edge 322 of another air passing hole 32*a* of the second shielding plate 32 with respect to the is adjacent to another edge portion of the air passage 29 opposite to the first-mentioned edge portion. In this state, the two air passing holes 31*a* and 32*a* completely overlap with the air passage 29.

Figure 18:
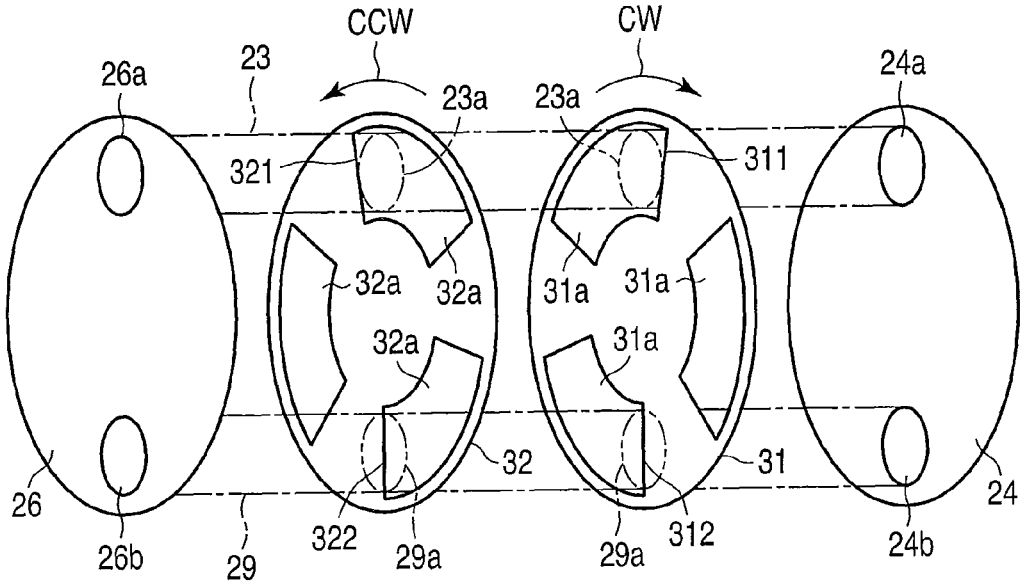
FIG. 18 is a view useful in explaining the operation of the valve device shown in FIG. 16.

When the two shielding plates 31 and 32 are rotated from their angular standby positions shown in FIG. 17 to the angular positions shown in FIG. 18, as indicated by the arrows shown in FIG. 17, in accordance with an "open" instruction issued from the control unit 10, the air passage 23 is opened, and at the same time, the air passage 29 is blocked. To this end, the angular velocity of each of the shielding plates 31 and 32 set in the standby state of FIG. 17 is gradually increased from 0. Thus, also in the second embodiment, the air passage 23 is fully opened and the air passage 29 is fully closed during the acceleration of the shielding plates 31 and 32 performed to shift the FIG. 17 state to the FIG. 18 state.

By thus simultaneously subjecting the air passages 23 and 29 to the full open state and full blocked state, respectively, during the acceleration of the shielding plates 31 and 32, the air passage 23 can be switched from the closed state to the open state within an extremely short time, and the air passage 29 can be switched from the open state to the closed state within the extremely short time. Namely, the valve device 30 can realize a very high response rate. To this end, it is important to set the FIG. 17 state as the standby state before opening the air passage 23 and closing the air passage 29, and to rotate the shielding plates 31 and 32 in different directions from their angular standby positions shown in FIG. 17.

Figure 19:
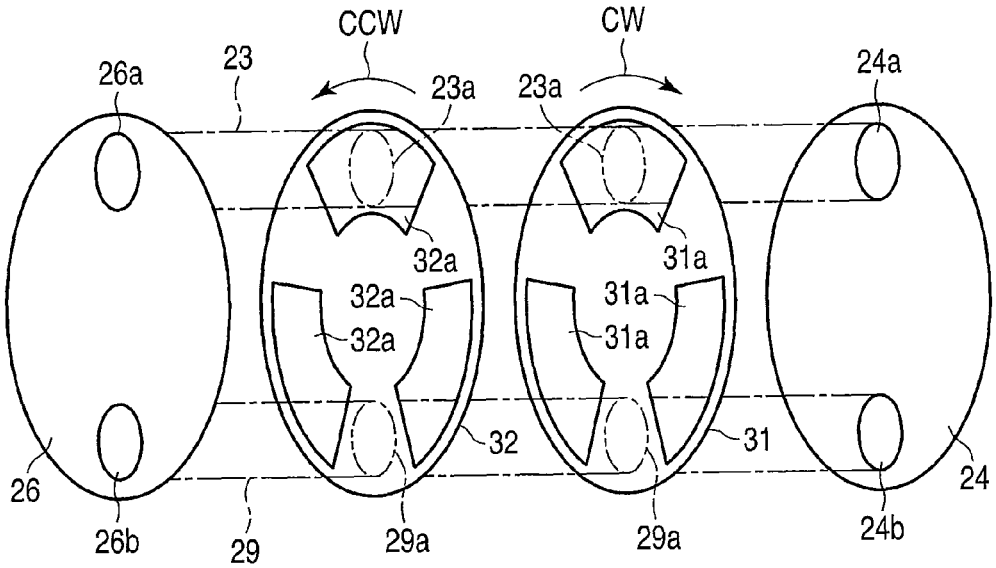
FIG. 19 is a view useful in explaining the operation of the valve device shown in FIG. 16.
Figure 20:
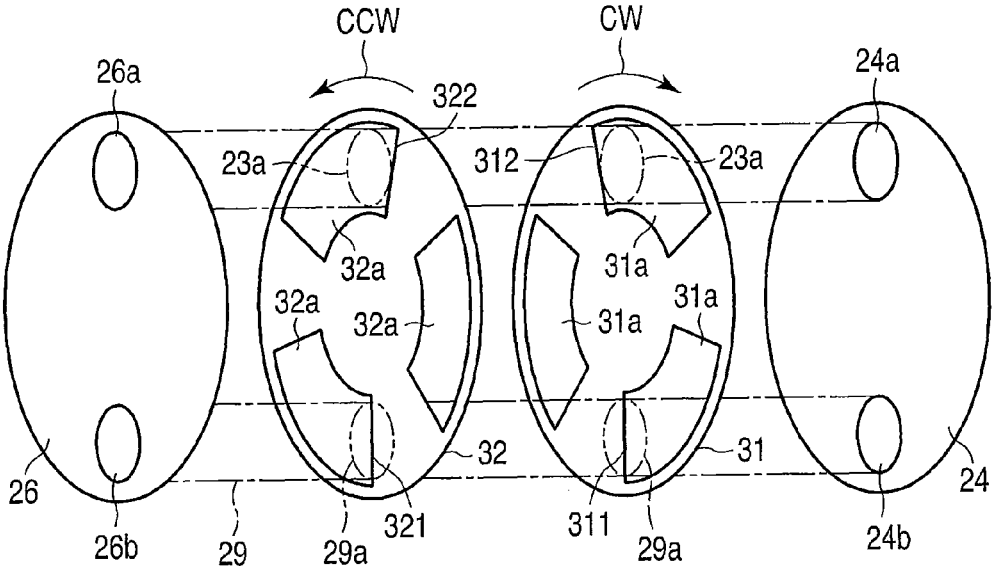
FIG. 20 is a view useful in explaining the operation of the valve device shown in FIG. 16.

Thereafter, the control unit 10 decelerates and stops the two shielding plates 31 and 32 while the FIG. 18 state is shifted to the FIG. 19 state and then to the FIG. 20 state. Specifically, in the second embodiment, while the FIG. 18 state is shifted to the FIG. 19 state, the two shielding plates 31 and 32 are decelerated and almost stopped, and while the FIG. 19 state is shifted to the FIG. 20 state, the two shielding plates 31 and 32 are slowly rotated to the other angular standby positions. Namely, at this time, the standby state shown in FIG. 20, which is assumed before the air passage 23 is blocked and the air passage 29 is opened, is established.

More specifically, in the standby state shown in FIG. 20, the CW directional trailing edge 312 of one of the air passing holes 31*a* of the first shielding plate 31 is adjacent to an edge portion of the air passage 23, and the CCW directional trailing edge 322 of one of the air passing holes 32*a* of the second shielding plate 32 is adjacent to another edge portion of the air passage 23 opposite to the first mentioned edge portion. In addition, the one air passing hole 31*a* and the one air passing hole 32*a* each completely overlap with the air passage 23.

At the same time, in the standby state shown in FIG. 20, the CW directional leading edge 311 of another air passing holes 31*a* of the first shielding plate 31 crosses the air passage 29, and the CCW directional leading edge 321 of another air passing holes 32*a* of the second shielding plate 32 crosses the air passage 29. In addition, said another air passing hole 31*a* does not overlap with said another air passing hole 32*a* within the air passage 29.

Figure 21:
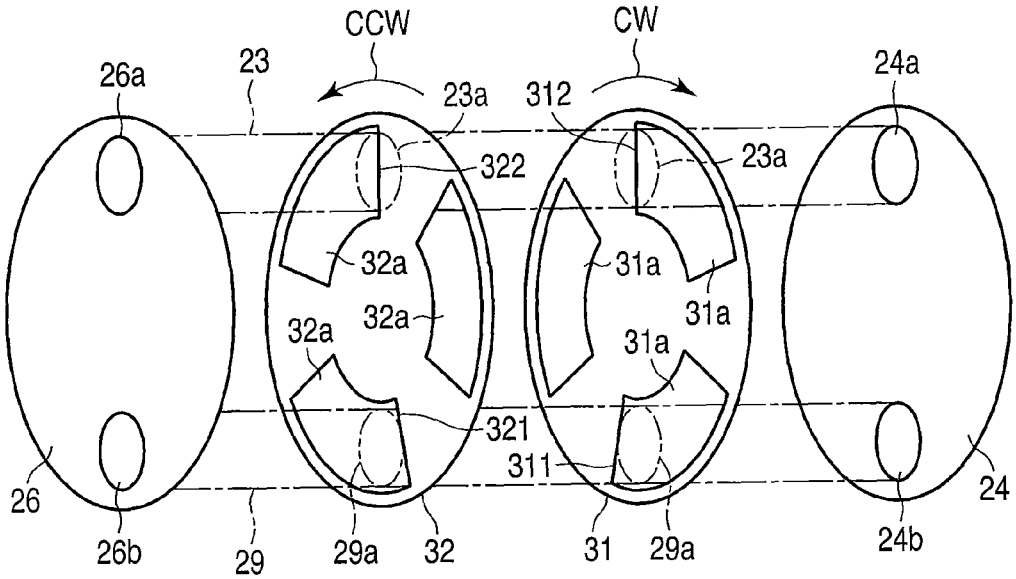
FIG. 21 is a view useful in explaining the operation of the valve device shown in FIG. 16.

When the two shielding plates 31 and 32 are rotated from the angular standby positions shown in FIG. 20 to the angular positions shown in FIG. 21 in accordance with a "close" instruction issued from the control unit 10, the air passage 23 is instantly closed, and the air passage 29 is instantly opened. Also in this case, the air passage 23 and the air passage 29 are closed and opened, respectively, during the acceleration of the shielding plates 31 and 32. Thus, the shielding plates 31 and 32 are prevented from deceleration. Further, the rotational angle (moving distance), through which each shielding plate 31 or 32 needs to move to completely block the air passage 23 and fully open the air passage 29, is an extremely small angle (short distance) corresponding to the angular movements of the trailing edges 312 and 322 of the air passing holes 31*a* and 32*a* from the respective edge portions of the air passage 23 to substantially the center of the air passage 23. From this, it is understood that the air passage 23 can be blocked and the air passage 29 be opened in a very short time.

To block the air passage 23 and open the air passage 29 in a short time, it is important to stop the shielding plates 31 and 32 at the angular standby positions shown in FIG. 20 assumed before blocking the air passage 23 and opening the air passage 29. By establishing this standby state, the rate of the opening/closing operation of the valve device 30 can be increased.

Figure 22:
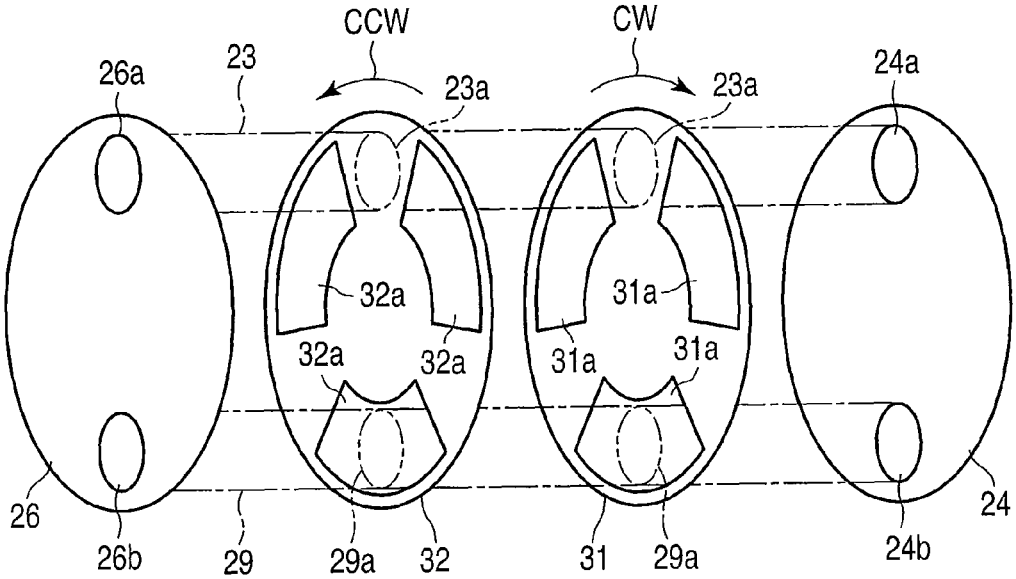
FIG. 22 is a view useful in explaining the operation of the valve device shown in FIG. 16.
Figure 23:
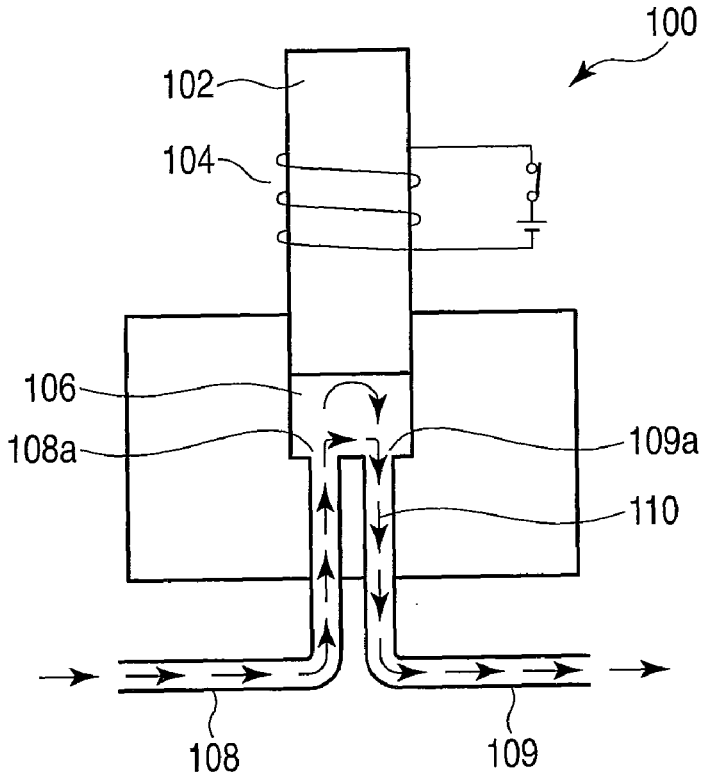
FIG. 23 is a schematic view illustrating the open state of a conventional standard solenoid valve.
Figure 24:
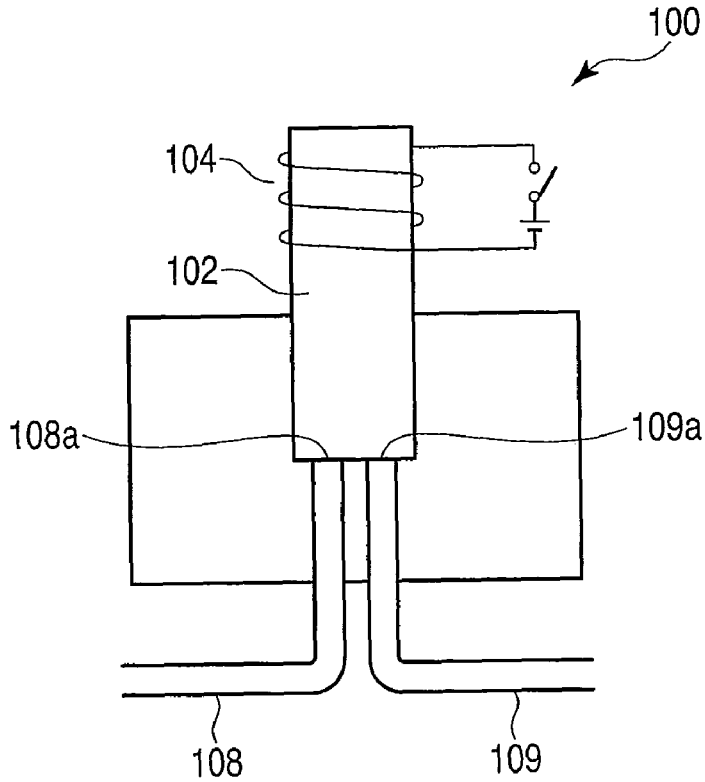
FIG. 24 is a schematic view illustrating the closed state of the solenoid valve shown in FIG. 23.

Thereafter, the control unit 10 decelerates and stops the shielding plates 31 and 32 while the FIG. 21 state is shifted to the FIG. 22 state and then returned to the FIG. 17 state.

The operations shown in FIGS. 17 to 22 are repeated to control the opening/closing operation of the valve device 30, thereby opening/closing the suction tube 22 and closing/opening the exhaust tube 28. As a result, negative pressure is applied to each paper sheet P set at the pickup position S to thereby attach the same to the pickup belt 4. This enables paper sheets P to be intermittently picked up to the conveyor path 9 one by one, and enables the internal pressure of the negative-pressure chamber 5 to be returned to the atmospheric pressure instantly. In the case of using the valve device 30 according to the second embodiment, three paper sheets P can be picked up while the shielding plates 31 and 32 are each rotated through 360°.

As described above, the second embodiment can provide the same advantage as the first embodiment, and can also instantly introduce a large amount of air into the negative-pressure chamber 5 when releasing the paper sheet P from the pickup belt.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For instance, although the above-described embodiments employ the endless pickup belt 4 as a pickup member for picking up each paper sheet p set at the pickup position S, the invention is not limited to this. Alternatively, a pickup member may be a rotor that has a plurality of suction holes and is rotatable in the sheet pickup direction.

Further, although the above-described embodiments employ the valve device 20 (30) including the two shielding plates 31 and 32 that cooperate to open/close the air passage 23 (29), the invention is limited to this. Alternatively, three or more shielding plates may be employed to make them cooperate to open/close a plurality of air passages. In this case, it is difficult to arrange all shielding plates coaxially, and hence the shielding plates may be made overlap each other so that their rotational axes are arranged parallel to each other.

Furthermore, although the valve device 20 (30) according to the above-described embodiments opens and closes a single air passage 23 or simultaneously opens and closes two air passages 23 and 29, the invention is not limited to this structure. The number of air passages controlled by a single valve device may be set arbitrarily.

In addition, although in the above-described embodiments, the two shielding plates cooperate to completely block the air passage(s) in a standby state assumed before opening the air passage, it is not always necessary to completely block the air passage, but a slight clearance may be defined between the two shielding plates.

What is claimed is:

1. A valve device comprising:

a first shielding plate movable across a fluid passage for passing a fluid therethrough, the first shielding plate including a first fluid passing hole which overlaps with the fluid passage when the first shielding plate is moving;

a second shielding plate adjacent to the first shielding plate, movable across the fluid passage and including a second fluid passing hole which overlaps with the fluid passage when the second shielding plate is moving; and a driving unit comprising a first motor and a second motor, the first motor configured to rotate the first shielding plate in a first rotational direction such that the first air passing holes across the fluid passage, the second motor configured to rotate the second shielding plate in a second rotational direction opposite to the first rotational direction, and the driving unit configured to make the first and second shielding plates cooperate with each other to close and open the fluid passage.

2. The valve device according to claim 1, wherein when the first and second shielding plates are set in respective standby positions before the fluid passage is opened, the driving unit keeps a front edge of the first fluid passing hole in the first moving direction crossing the fluid passage, and keeps a front edge of the second fluid passing hole in the second moving direction crossing the fluid passage.

3. The valve device according to claim 2, wherein the driving unit starts to move the first and second shielding plates from the standby positions, and accelerates movement of the first and second shielding plates, the fluid passage being fully opened during acceleration of the movement of the first and second shielding plates.

4. The valve device according to claim 1, wherein when the first and second shielding plates are set in respective standby positions before the fluid passage is closed, the driving unit keeps a rear edge of the first fluid passing hole in the first moving direction adjacent to an edge portion of the fluid passage, and keeps a rear edge of the second fluid passing hole in the second moving direction adjacent to another edge portion of the fluid passage opposite to the first-mentioned edge portion, the first and second fluid passing holes being kept completely overlapping with the fluid passage.

5. The valve device according to claim 4, wherein the driving unit starts to move the first and second shielding plates from the standby positions, and accelerates movement of the first and second shielding plates, the fluid passage being closed during acceleration of the movement of the first and second shielding plates.

6. A valve device comprising:

a first shielding plate rotatable across a first fluid passage for passing a fluid therethrough, and across a second fluid passage separate from the first fluid passage, the first shielding plate including a plurality of first fluid passing holes which overlap with the first and second fluid passages when the first shielding plate is rotating;

a second shielding plate adjacent to the first shielding plate, rotatable across the first and second fluid passages and including a plurality of second fluid passing holes which overlap with the first and second fluid passages when the second shielding plate is rotating; and a driving unit comprising a first motor and a second motor, the first motor configured to rotate the first shielding plate in a first rotational direction such that the first air passing holes cross the first and second fluid passages, the second motor configured to rotate the second shielding plate in a second rotational direction opposite to the first rotational direction, and the driving unit configured to make the first and second shielding plates cooperate with each other to close and open the first and second fluid passages.

7. The valve device according to claim 6, wherein when the first and second shielding plates are set in respective standby positions before the fluid passage is opened, the driving unit keeps a front edge of one of the first fluid passing holes in the first moving direction crossing the first fluid passage, keeps a front edge of one of the second fluid passing holes in the second moving direction crossing the second fluid passage, and keeps other first and second air passing holes overlapping with the second fluid passage.

8. The valve device according to claim 7, wherein the driving unit starts to move the first and second shielding plates from the standby positions, and accelerates movement of the first and second shielding plates, the fluid passage being fully opened and the second fluid passage being closed during acceleration of the movement of the first and second shielding plates.

9. The valve device according to claim 6, wherein when the first and second shielding plates are set in respective standby positions before the first fluid passage is closed, the driving unit keeps a rear edge of one of the first fluid passing holes in the first moving direction adjacent to an edge portion of the first fluid passage, and keeps a rear edge of one of the second fluid passing holes in the second moving direction adjacent to another edge portion of the first fluid passage opposite to the first-mentioned edge portion, thereby keeping the one first fluid passing hole and the one second fluid passing hole completely overlapping with the first fluid passage, the driving unit also keeping a front edge of another first fluid passing hole in the first moving direction crossing the second fluid passage, and keeping a front edge of another second fluid passing hole in the second moving direction crossing the second fluid passage; said another first fluid passing hole and said another second fluid passing hole being prevented from overlapping with each other.

10. The valve device according to claim 9, wherein the driving unit starts to move the first and second shielding plates from the standby positions, and accelerates movement of the first and second shielding plates, the first fluid passage being closed and the second fluid passage being opened during acceleration of the movement of the first and second shielding plates.

11. A paper sheet pickup apparatus comprising:

an input unit configured to receive a plurality of paper sheets accumulated;

a pickup member including a suction hole and configured to run along one of accumulated paper sheets, the one paper sheet being positioned at a most downstream side with respect to a direction of accumulation;

a negative-pressure generating unit configured to draw air through the suction hole from a reverse side of the pickup member, thereby generating negative pressure on a surface of the pickup member to attach thereon the one paper sheet;

a suction unit connected to the negative-pressure generating unit via a fluid passage; and a valve device provided across the fluid passage, wherein the valve device comprises:

a first shielding plate movable across the fluid passage, and including a first fluid passing hole which overlaps with the fluid passage when the first shielding plate is moving;

a second shielding plate adjacent to the first shielding plate, movable across the fluid passage, and including a second fluid passing hole which overlaps with the fluid passage when the second shielding plate is moving; and a driving unit comprising a first motor and a second motor, the first motor configured to rotate the first shielding plate in a first rotational direction such that the first air passing holes cross the fluid passage, the second motor configured to rotate the second shielding plate in a second rotational direction opposite to the first rotational direction, and the driving unit configured to make the first and second shielding plates cooperate with each other to close and open the fluid passage.

12. The paper sheet pickup apparatus according to claim 11, wherein when the first and second shielding plates are set in respective standby positions before the fluid passage is opened, the driving unit keeps a front edge of the first fluid passing hole in the first moving direction crossing the fluid passage, and keeps a front edge of the second fluid passing hole in the second moving direction crossing the fluid passage.

13. The paper sheet pickup apparatus according to claim 12, wherein the driving unit starts to move the first and second shielding plates from the standby positions, and accelerates movement of the first and second shielding plates, the fluid passage being fully opened during acceleration of the movement of the first and second shielding plates.

14. The paper sheet pickup apparatus according to claim 11, wherein when the first and second shielding plates are set in respective standby positions before the fluid passage is closed, the driving unit keeps a rear edge of the first fluid passing hole in the first moving direction adjacent to an edge portion of the fluid passage, and keeps a rear edge of the second fluid passing hole in the second moving direction adjacent to another edge portion of the fluid passage opposite to the first-mentioned edge portion, the first and second fluid passing holes being kept completely overlapping with the fluid passage.

15. The paper sheet pickup apparatus according to claim 14, wherein the driving unit starts to move the first and second shielding plates from the standby positions, and accelerates movement of the first and second shielding plates, the fluid passage being closed during acceleration of the movement of the first and second shielding plates.

16. A paper sheet pickup apparatus comprising:

an input unit configured to receive a plurality of paper sheets accumulated;

a pickup member including a suction hole and configured to run along one of accumulated paper sheets, the one paper sheet being positioned at a most downstream side with respect to a direction of accumulation;

a negative-pressure generating unit configured to draw air through the suction hole from a reverse side of the pickup member, thereby generating negative pressure on a surface of the pickup member to attach thereon the one paper sheet;

a suction unit connected to the negative-pressure generating unit via a first fluid passage; and a valve device provided across the first fluid passage and across a second fluid passage, wherein the valve device comprises:

a first shielding plate rotatable across the first and second fluid passages, and including a plurality of first fluid passing holes which overlap with the first and second fluid passages when the first shielding plate is rotating;

a second shielding plate adjacent to the first shielding plate, rotatable across the first and second fluid passages and including a plurality of second fluid passing holes which overlap with the first and second fluid passages when the second shielding plate is rotating; and a driving unit comprising a first motor and a second motor, the first motor configured to rotate the first shielding plate in a first rotational direction such that the first air passing holes cross the first and second fluid passages, the second motor configured to rotate the second shielding plate in a second rotational direction opposite to the first rotational direction, and the driving unit configured to make the first and second shielding plates cooperate with each other to close and open the first and second fluid passages.

17. The paper sheet pickup apparatus according to claim 16, wherein the second fluid passage connects an exhaust hole formed in the suction unit to the negative-pressure generating unit.

* * * * *